United States Patent [19]

Montalvo

[11] 4,146,026

[45] Mar. 27, 1979

[54] FILTER MASK

[76] Inventor: Victor H. Montalvo, 1736 St. Mary's Ave., Owensboro, Ky. 42301

[21] Appl. No.: 777,594

[22] Filed: Mar. 15, 1977

[51] Int. Cl.[2] ..... A62B 7/10

[52] U.S. Cl. ..... 128/146.6; 128/142.6; 131/173

[58] Field of Search ..... 128/146.6, 146.2, 142.6, 128/146.4, 202, 195, 186, 205, 145 R, 146 R; 131/173 R, 172 R

[56] References Cited

U.S. PATENT DOCUMENTS

| | | | |
|---|---|---|---|
| 556,335 | 3/1896 | Cottingham | 128/186 |
| 1,948,945 | 2/1934 | Seijo | 128/146.6 |
| 2,088,720 | 8/1937 | Poliniak | 128/146.4 |
| 3,980,080 | 9/1976 | Muto | 128/146.6 |

FOREIGN PATENT DOCUMENTS

| | | | |
|---|---|---|---|
| 959619 | 3/1957 | Fed. Rep. of Germany | 128/146.6 |

*Primary Examiner*—Henry J. Recla
*Attorney, Agent, or Firm*—Warren D. Flackbert

[57] ABSTRACT

A filter mask characterized by a filter receptacle which carries a liquid, such as water, into which a plurality of air inlet tubes extend. Air is drawn through the liquid by reason of the vacuum caused by breathing, filtering the contamination, and then passes through an associated face mask. The filter mask effectively removes contaminates in the air, as various forms of dust, solid or semi-solid particles, pollen, chemicals and the like.

1 Claim, 3 Drawing Figures

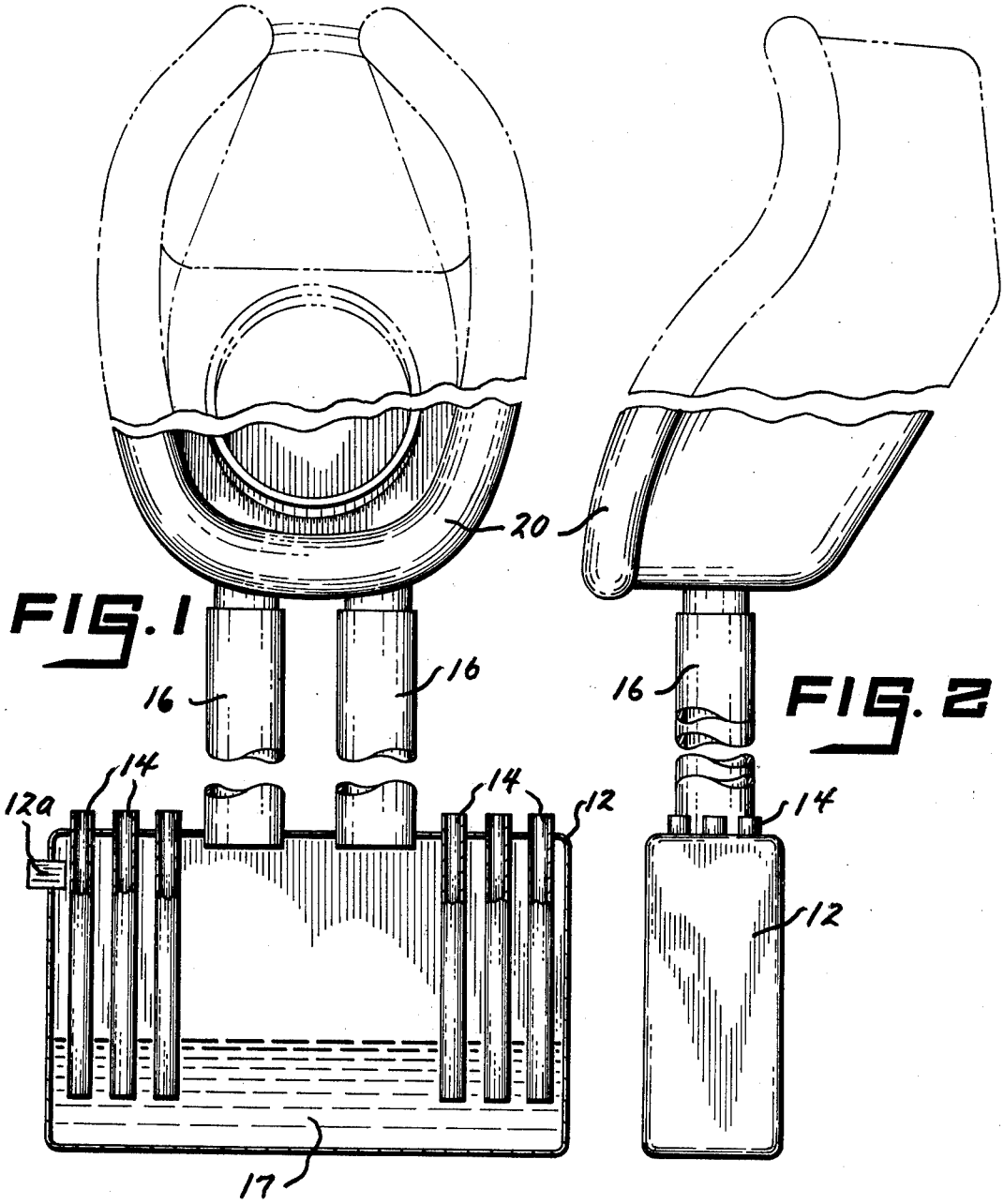
FIG. 1
FIG. 2
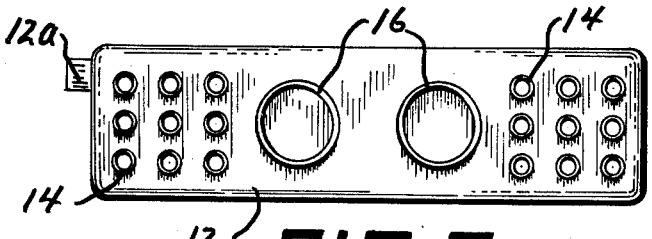
FIG. 3

FILTER MASK

As is known, various occupations require working under conditions which could be detrimental to health, as, for example, under a dust environment, as farming, and in the areas of mining. Oftentimes the presence of pollen, either at or away from work, could serve to create difficulty. A need has arisen, therefore, for a filter which is light in weight, which can be effectively held by or mounted on the person of the user, and which, importantly, is effective in the removal of contaminates.

The invention satisfies the preceding requirements. Briefly, the filter mask herein comprises a face mask communicating with a filter receptacle which partly contains a liquid, such as water or light oil. Contaminated air is introduced into the liquid by means of a series of air inlet tubes, then passing through the liquid by reason of vacuum action created by breathing. The undesired contaminates are thereby filtered from the air.

The filter mask of the invention is readily carried by the user, or even strapped onto the user when it is desired to leave hands free for performing any desired task. Importance lies in the relationship between the area of the sums of the air inlet tubes and the outlet tubes, i.e. the sum of the end areas of the inlet tubes must be equal to or greater than the sum of the end areas of the outlet tubes.

In any event, a better understanding of the present invention will become more apparent from the following description, taken in conjunction with the accompanying drawing, wherein FIG. 1 is a view in front elevation, partly in vertical section, showing a filter mask in accordance with the teachings of the present invention;

FIG. 2 is a view in side elevation of the filter mask of FIG. 1, looking from right to left in such figure; and, FIG. 3 is a top plan view of the filter mask, with the face mask removed.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Referring now to the figures, the filter mask of the invention is defined by a filter receptacle 12, the upper surface of which positions air inlet tubes 14 and air outlet tubes 16. The particular arrangement or grouping of air inlet tubes 14 and air outlet tubes 16 can be designed for a desired application or usage, one qualification being that the sum of the areas of the ends or faces of air inlet tubes 14 must be equal to or larger than the sum of the areas of the ends or faces of the outlet tubes 16.

The filter receptacle 12 receives a liquid 17, such as water, filling and emptying being achieved through a plug 12*a*. The filter receptacle 12, air inlet tubes 14 and air outlet tubes 16 are typically made from a molded plastic resin and the plug 12*a* may be cork or the like.

A conventional face mask 20 is positioned by the air outlet tubes 16. As shown, the overall unit can be held and positioned so that breathing can be accomplished through a cupped relationship between the user and the face mask 20. While not shown, support straps could be provided for positioning the filter mask on the head of the user, which, in such instance, permits the user's hands to be free for accomplishing work tasks or the like.

In any event, the level of the liquid 17 in the receptacle 12 should be sufficient to cover the lower ends of the air inlet tubes 14, i.e. to accommodate movement of the user's head. As an approximate guide, the liquid level can extend one-third the height of the filter receptacle 12, where the air inlet tubes 14 may extend downwardly five-sixths of the height of the filter receptacle.

In use, contaminated air passes through the liquid 17 by the vacuum created by breathing. As the air is drawn through the liquid 17, the contaminated particles remain in the liquid 17 and the user is provided with safe air. Depending upon the degree of air contaminations, the liquid 17 is replaced from time to time through the opening normally blocked by the aforesaid plug 12*a*.

It should be evident that the filter mask of the invention has a wide application of end purposes, as, for example, in the removal of dust; solid particles; chemicals, and like pesticides; dust occasioned by reason of mining operations; and, even to the extent of pollen, all of the preceding contaminants being carried by air. The invention provides effectiveness in use, is light in weight, and ready adaptability in handling at the site of air pollution.

The described filter mask is susceptible to various changes within the spirit of the invention, as, for example, in proportioning, material choice and the like. Thus, the preceding should be considered illustrative and not as limiting the scope of the following claims.

I claim:

1. A filter mask comprising a filter receptacle having a top portion and a bottom portion for receiving a liquid, a plurality of open-ended air inlet tubes having the same size inlet and outlet ends, said inlet ends mounted on and extending through said top portion in open communication with the surrounding atmosphere, said outlet ends extending to a position adjacent said bottom portion of said receptacle and thereby into said filter receptacle and into said liquid, air outlet tubes having first ends mounted on the top portion of said filter receptacle above the level of said liquid and communicating with the interior thereof, and a face mask, said face mask communicating with the other ends of said air outlet tubes in an air filtering path including said air inlet tubes and said liquid, and where the sum of the cross-sectional air flow areas of said air inlet tubes is at least equal to the air flow areas of said air outlet tubes.

* * * * *